US005829263A

United States Patent [19]

Park

[11] Patent Number: 5,829,263

[45] Date of Patent: Nov. 3, 1998

[54] METHOD FOR CONTROLLING WATER SUPPLY OF AUTOMATIC ICE MAKER IN REFRIGERATOR AND WATER SUPPLY DEVICE EMPLOYING THE SAME

[75] Inventor: Hyeong-Nam Park, Seoul, Rep. of Korea

[73] Assignee: Daewoo Electronics Co., Ltd., Rep. of Korea

[21] Appl. No.: 867,023

[22] Filed: May 30, 1997

[30] Foreign Application Priority Data

Aug. 31, 1996 [KR] Rep. of Korea ..... 96-37467

[51] Int. Cl.[6] ..... F25D 17/00; F25B 19/00

[52] U.S. Cl. ..... 62/177; 62/233; 222/59

[58] Field of Search ..... 62/233, 353, 340, 62/177; 222/59

[56] References Cited

U.S. PATENT DOCUMENTS 5,596,182 1/1997 Edwards et al. ..... 62/233 X
5,697,222 12/1997 Lee ..... 62/233 X

*Primary Examiner*—William W. Wayner
*Attorney, Agent, or Firm*—Cushman Darby & Cushman Intellectual Property Group of Pillsbury Madison & Sutro, LLP

[57] ABSTRACT

A method for controlling water supply in an automatic ice maker comprises the steps of establishing a table for a water supply time versus a non-load current; starting a timer for measuring the water supply time after turning on a water supply motor; detecting the current in the water supply motor by using a hall sensor; turning off the water supply pump and displaying the depleted state of a water supply reservoir when the water supply motor current detected by the hall sensor is equal to or lower than the non-load current; determining a water supply time, from the table, corresponding to the detected water supply motor current, when the detected current is higher than the non-load current; and turning off the water supply motor after resetting the timer if the current time of the timer is same or more than the determined water supply time. A water supply control device comprises: a device for driving a water supply motor to operate a water supply pump according to a control signal; a hall sensor for detecting magnetic field generated by the current in the water supply motor; an amplifier for amplifying an output of the hall sensor; a display circuit for displaying the depleted status of the water supply reservoir; and a mi-com for: starting a timer after turning on the water supply motor; outputting an amplified signal to an analog input port to detect a motor current, outputting a control signal to turn off the water supply motor and to display circuit when the non-load current is detected, whereas outputting a control signal to turn off the water supply motor after determining a water supply time corresponding to the detected current higher than the non-load current, if the current time is greater than or equal to the corresponding water supply time.

4 Claims, 6 Drawing Sheets

METHOD FOR CONTROLLING WATER SUPPLY OF AUTOMATIC ICE MAKER IN REFRIGERATOR AND WATER SUPPLY DEVICE EMPLOYING THE SAME

BACKGROUND OF THE INVENTION

1. Field of the Invention

The present invention relates to an automatic ice maker, and more particularly to a method for controlling water supply of an automatic ice maker in a refrigerator and water supply device employing the same, in which a hall sensor controls water supply by sensing a magnetic field generated by an electric current in the device.

2. Description of the Prior Art

Generally, in a refrigerator with an automatic ice maker, a controlled amount of water is supplied to an ice tray by a water supply device. Once the water is frozen, the ice tray is rotated downward by a driving means, such that the ice is emptied into a storing bin. Shortly after, the ice tray is refilled, and the process is repeated and carried out continuously during the normal operation of the refrigerator.

FIG. 1 is a sectional view showing a conventional refrigerator provided with an ice service compartment. A main body 1 of the refrigrator, a freezer compartment 2, a fresh food compratment 3 and the ice service compartment 4 are shown, and the cool air generated by an evaporator 6 is transferred to each compartment by a blowing fan 5. An automatic ice maker according to the present invention is installed in the ice service compartment 4, and driving means consisting of a motor, a gear mechanism and a shaft are installed in a driving part 16 of the automatic ice maker.

An ice tray 15 is made of, for example, a plastic material internally divided into a multiple identical rectangular shape separated by a groove.

A first detecting means for detecting the horizontal status and a second detecting means for detecting the vertical status of the ice tray 15 are installed adjacent to a shaft supporting the ice tray 15, so that the position of the ice tray 15 is detected precisely during its movement. A thermal sensor is installed adjacent to the ice tray 15.

Directly below the ice tray 15, a storage bin 17 is movably mounted, so it can be moved in and out of the ice service compartment or the freezer compartment.

A water supply device 10 located in the fresh food compartments consists of a water reservoir 11, a water supply pump 13 for pumping the water stored in the water reservoir 11, a water pipe 14 for supplying the water to the ice tray 15. The front end of the water pipe 14 is directly above the ice tray 15, and the operation of the water supply pump 13 is controlled by the control circuit (not shown).

A water supply port 12 for supplying the water reservoir 11 is connected at the one end of the reservoir.

FIG. 2 shows a water supply mechanism of a conventional refrigerator, and FIG. 3 is a block diagram that illustrates a conventional water control device with a couple of probes attached.

FIG. 2 shows the detail description of a water reservoir 21. When the water in the water reservoir 21 is depleted, the water reservoir 21 can be moved out of the fresh food compartment 3 to be refilled via a water supply port 24 mounted on the reservoir, which also prevents the water from flowing out of the water reservoir 21 by a valve 23 supported by the elastic force of the spring. Alternately, the water supply reservoir can be supplied directly from the outside via a connecting pipe (not shown).

The water reservoir 21 is mounted above an auxiliary reservoir 22. When the valve 23 of the water supply port opens, the water in the water reservoir 21 flows into the auxiliary reservior 22. At this time, the level of water in the auxiliary reservoir 22 rises, and when it rises to the bottom of the water supply port 24, the flow of the water is stopped by a hydraulic pressure. The water in the auxiliary reservoir 22 is supplied to an ice tray 27 via a water pipe 26 by the operation of a water supply pump 25. As the amount of water in the auxiliary reservoir 22 decreases, the water continuously flows into the reservoir 23 via the opened valve 23. During the above process, a constant amount of the water is maintained in the auxiliary reservoir 22.

In a conventional water supply control method, as shown in FIG. 3, when both a first probe 29*a* and a second probe 29*b* makes contact with the water stored in the auxiliary reservoir 22, the electric current conducts from the first problem 29*a* to the second probe 29*b* (or vice versa), to determine the presence of water. On the contrary, as the water in the auxiliary reservoir 22 is depleted, the electric current is not conducted from the first probe 29*a* to the second problem 29*b* (or vice versa), and the depletion of water in the auxiliary reservoir is determined.

More specifically, when a current sensing part 31 detects an electrical current between the first probe 29*a* and the second probe 29*b*, it outputs a hi-signal to a mi-com 32. The mi-com 32 then determines the presence of water in the auxiliary reservoir 22 to activate a motor driving part 33 to drive a water supply pump 25.

When the water supply reservoir 21 is depleted, the current sensing part 31 outputs a low signal to the mi-com 32. Accordingly, the mi-com 32 determines the depletion of water in the water supply reservoir 21 to stop the operation of the water supply mechanism.

The conventional water supply device has the problems as the following. That is, the probes of the current sensing part 31 touches the water directly, and often a foreign substance attaches to the probes to interrupt the current conduction and causes an electrical drift. Additionally, a moisture forms on the holder 28 to cause a malfunction of the water control device.

SUMMARY OF THE INVENTION

Accordingly, it is an object of the present invention to provide a method for controlling water supply of an automatic ice maker in a refrigerator and water supply device of an automatic ice maker employing the same, in which a hall sensor controls water supply by sensing a magnetic field generated by an electric current in the device.

In order to achieve the above object, the present invention provides a method for controlling water supply in an automatic ice maker for supplying the water stored in a water reservoir to an ice tray by operating a water supply pump, comprising the steps of: establishing a table for a water supply time versus non-load current; starting a timer for measuring the water supply time after turning on a water supply motor; detecting the current in the water supply motor by using a hall sensor; turning off the water supply pump and displaying the depleted status of a water supply reservoir, when the water supply motor current detected by the hall sensor is equal to or less than the non-load current; determining a water supply time, from the tale, corresponding to the dectected water supply motor current, when the detected water supply motor current is larger than the non-load current; and turning off the water supply motor after resetting the timer if the current time of the timer is equal to or greater than the determined water supply time.

To accomplish the above object, the present invention also provides a water supply control device in an automatic ice maker for supplying water stored in a water reservoir to an ice tray by operating a water supply pump, comprising: a driving means for driving a water supply motor to activate a water supply pump according to a control signal; a hall sensor for detecting magnetic field generated by the water supply motor current; an amplifier for amplifying an output of the hall sensor; a display circuit for displaying the depleted status of the water supply reservoir; and a mi-com for: starting a timer after tuning on the water supply motor; outputting an amplified signal to an analog input port to detect a motor current; comparing the detected motor current to the non-load current; outputting a control signal to turn off the water supply motor and to the display circuit when the non-load current is detected, whereas outputting a control signal to turn off the water supply motor after determining a water supply time corresponding to the detected current greater than the non-load current, if the current time is greater than or equal to the corresponding water supply time.

BRIEF DESCRIPTION OF THE DRAWINGS

The present invention will be better understood and its various objects and advantages will be more fully appreciated from the following description taken in conjunction with the accompanying drawings, in which.

DESCRIPTION OF THE PREFERRED EMBODIMENT

Reference will now be made in detail to the present invention, examples of which are illustrated in the accompanying drawings. Wherever possible, the same reference numbers will be used throughout the drawings to refer to the same or like parts.

A water supply device according to the present invention has a water supply reservoir 11, a water supply pump 13 and a water pipe 14.

Figure 1:
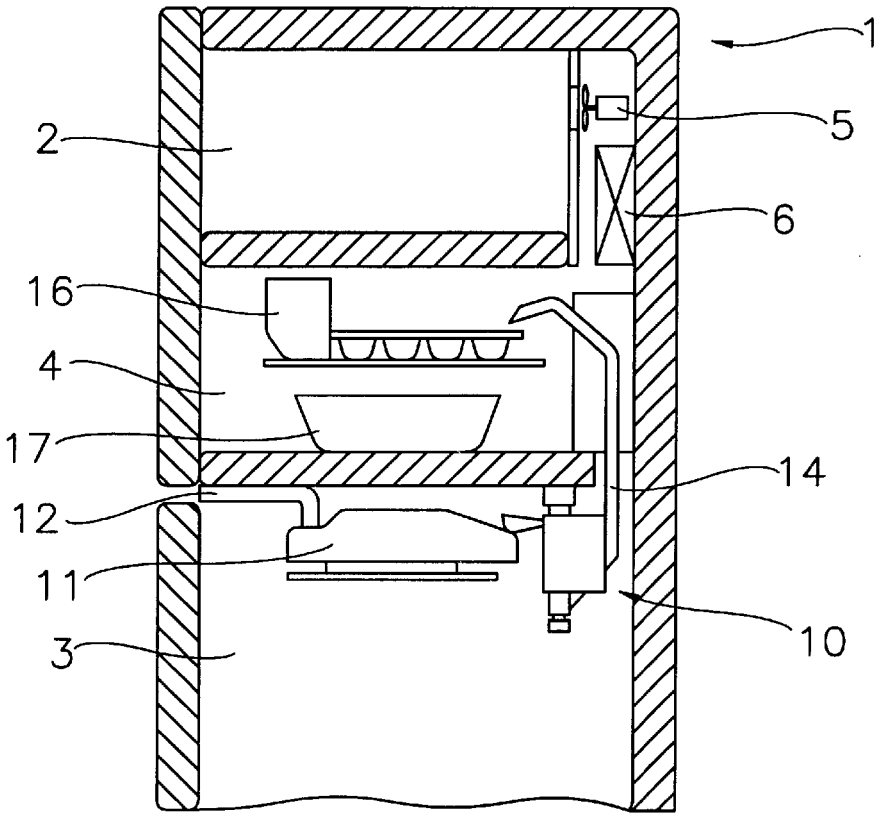
FIG.1(PRIOR ART)
FIG. 1 is a sectional view of a conventional refrigerator provided with an ice service compartment.
Figure 2:
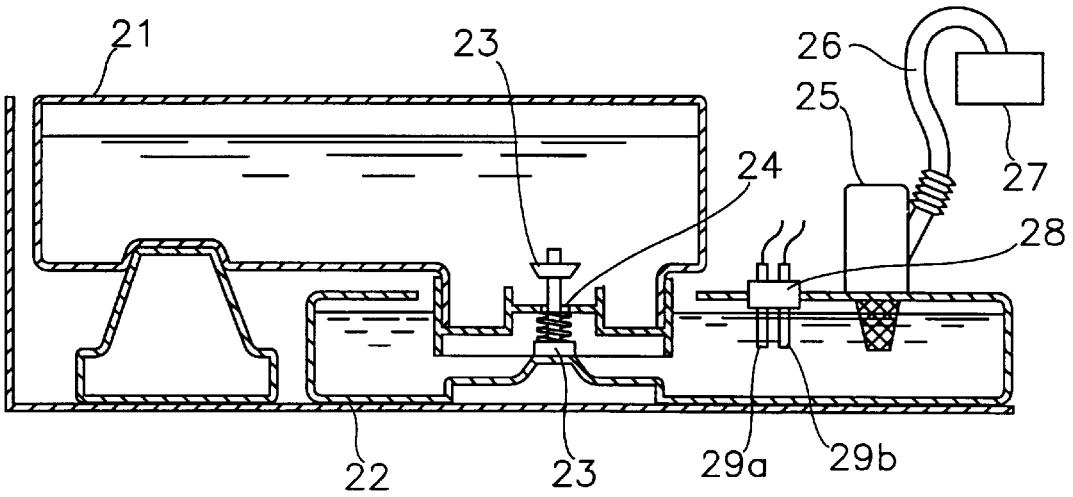
FIG.2(PRIOR ART)
FIG. 2 shows a water supply mechanism of a conventional refrigerator.
Figure 3:
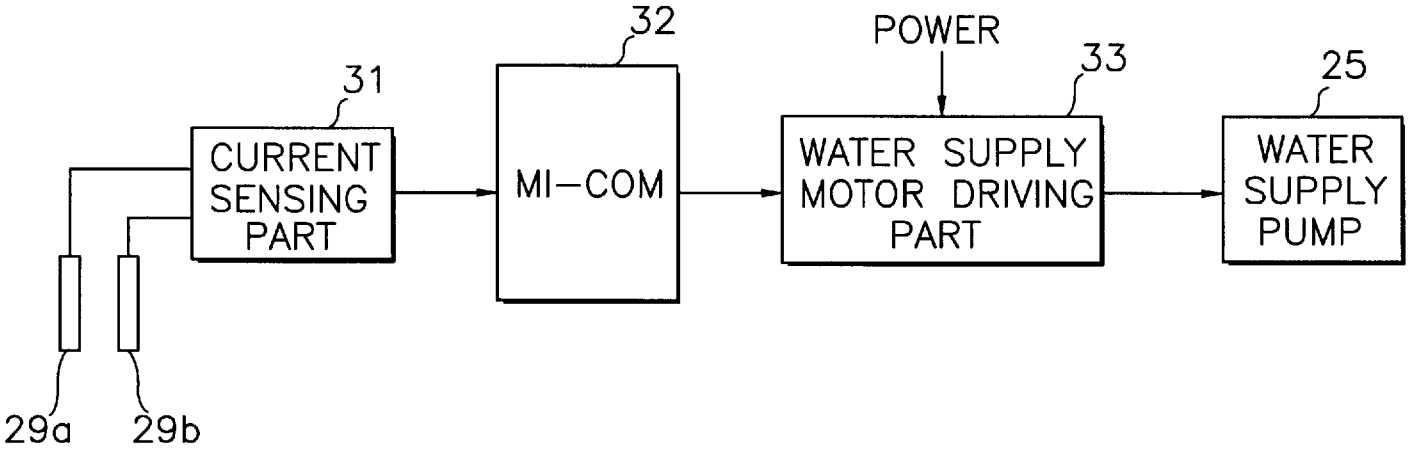
FIG.3(PRIOR ART)
FIG. 3 is a block diagram of a conventional water control device with a couple of probes attached.
Figure 4:
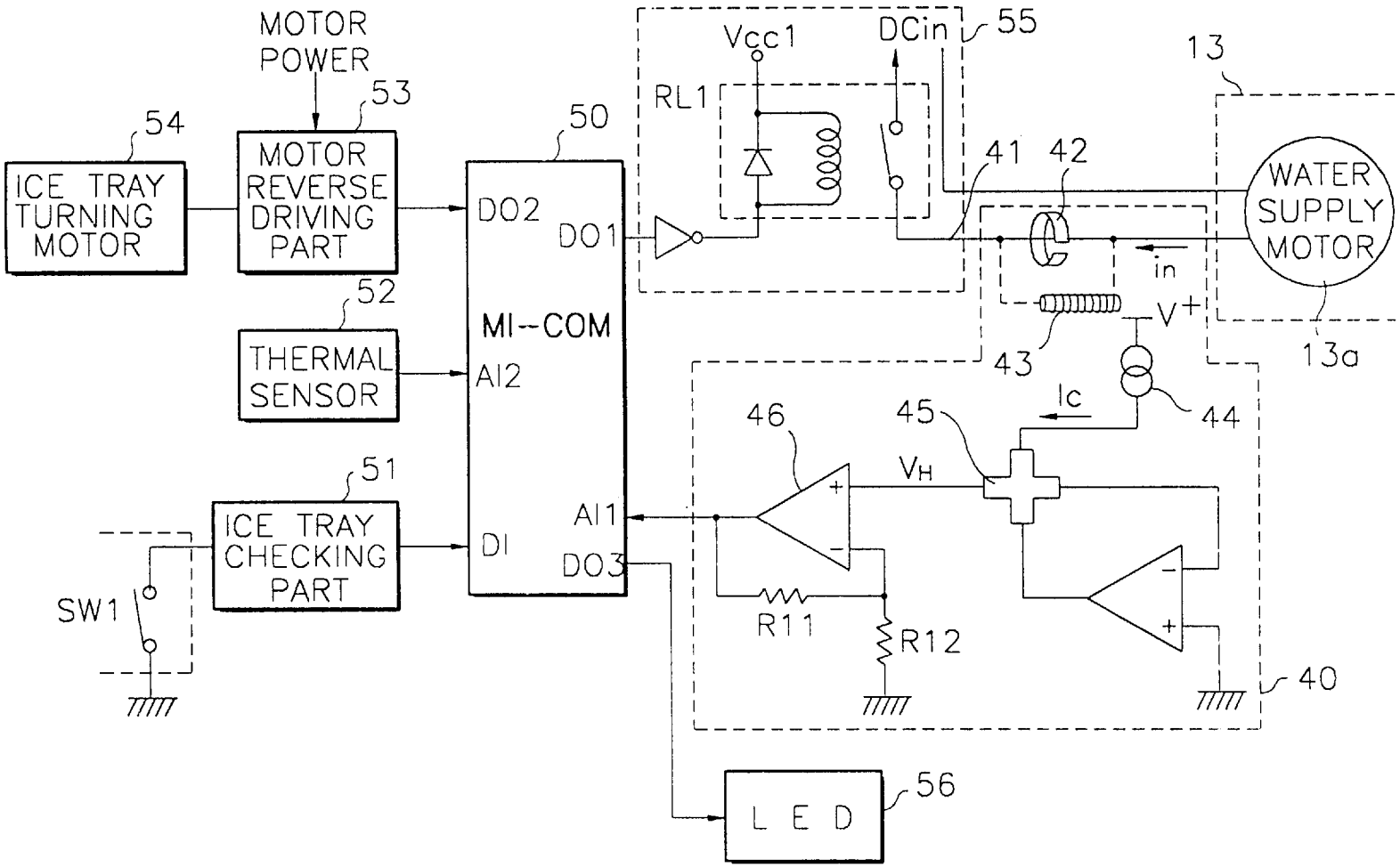
FIG. 4 is a block diagram of a water control device according to the present invention.

The water control device comprises, as shown in FIG. 4, a mi-com 50, an ice tray checking part 51, a thermal sensor 52, a motor driving part 55, a water supply pump 13, a LED 56, a motor reverse driving part 53, and ice tray turning motor 54.

The thermal sensor 52 is installed ajacent to the ice tray 15. The ice tray checking part 51 outputs a hi-signal or a low-signal depending on the level of the ice tray 17 determined by a sensing switch SW1. The motor reverse driving part 53 drives the ice tray turning motor 54 by the controll of the mi-com 50. The LED 56 displays the depletion status of a water supply reservoir 56.

The motor driving part 55 is provide with a relay RL1 for connecting or interrupting the power supplied to a water supply motor 13*a*. When the water supply motor 13*a* is driven, the water in the water supply reservoir 11 is supplied to the ice tray 15.

At this point, the current im from the motor driving part 55 to the water supply motor 13*a* is sensed by a hall sensor 45 installed in a cylindrcal yoke 42 surrounding a wire 41.

The hall sensor 45, using the hall effect, has the elements of GaAs, InSb, Ge ,etc, and employes the element driving methods such as the rated current method and the rated voltage method. The present invention utilizes the rated current method, that is, the magnetic field generated by the current im of the motor is transformed into hall voltate V(H). When the driving current provided by a rated current source 44 is input to the hall sensor 45, the hall sensor 45 senses the magnetic field generated by the motor current. A hall voltage from the hall sensor 45 is amplified at a driven amplifier 46 to be directly input to the analog input port of the mi-com 50. That is, the motor current has the respective value according to the normal load or the non load. The normal load indicates the presence of water in the water supply reservoir and the non load indicates the water supply reservoir is empty.

In general, the current in non-load period is lower than in the normal load period (for example, about 150 mA in the normal load period and about 80 mA in the non-load period). The presence of water in the water supply reservoir 11 is determined by detection of the difference of the hall voltage according to the motor current. Accordingly, the amplified hall voltage is input to the analog input port of the mi-com directly, and the mi-com transforms the hall voltage into a digital value. The digitalized valve is compared with a predetermined valve, and the motor current is determined as a normal load or non-load current.

The hall sensor 45, as shown in FIG. 4, is positioned in the vicinity of the wire core 43 directly connected to the wire 41, senses the magnetic field generated from the the wire core 43.

Figure 5:
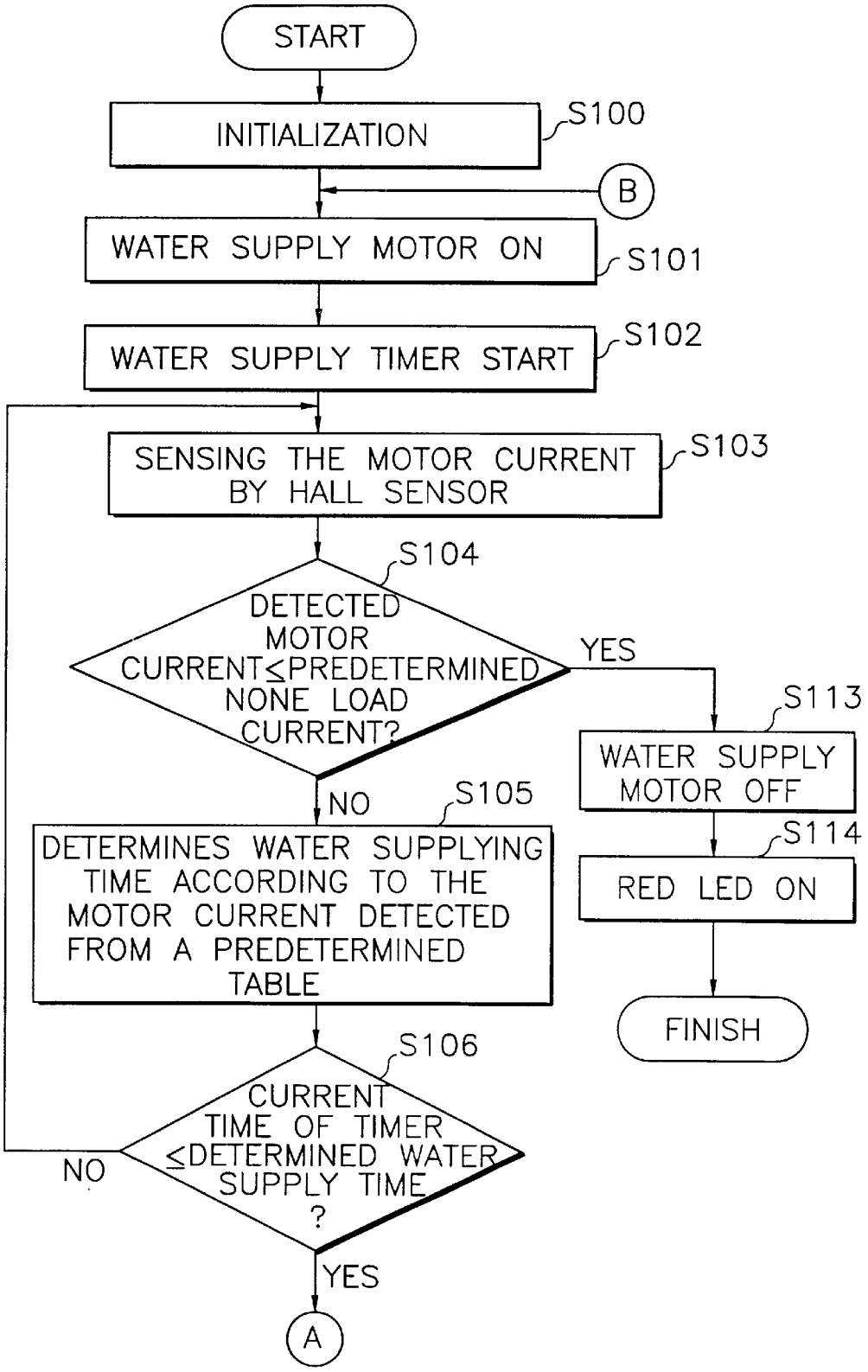
FIG. 5 shows a step operation of a water supply device according to the present invention.

FIG. 4 shows a block diagram according to the present invention, and FIG. 5 shows the operation of an automatic ice maker according to the present invention.

Figure 6:
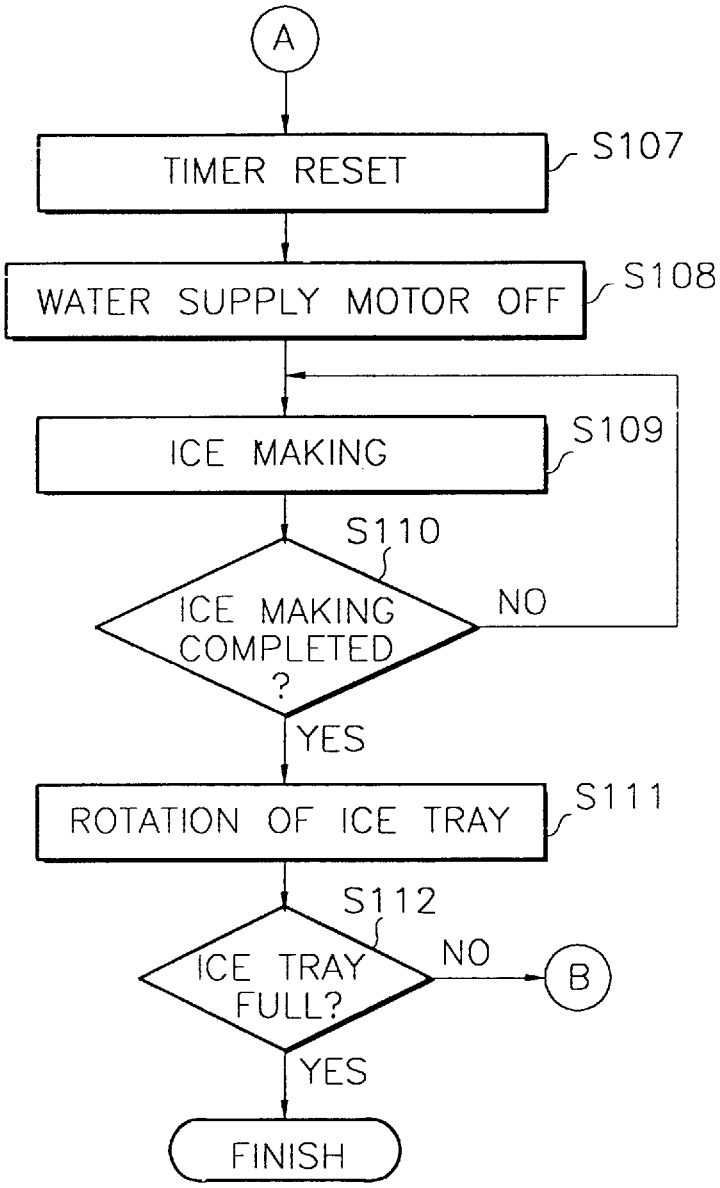
FIG. 6 shows a step operation of an ice making process according to the present invention.
Figure 7:
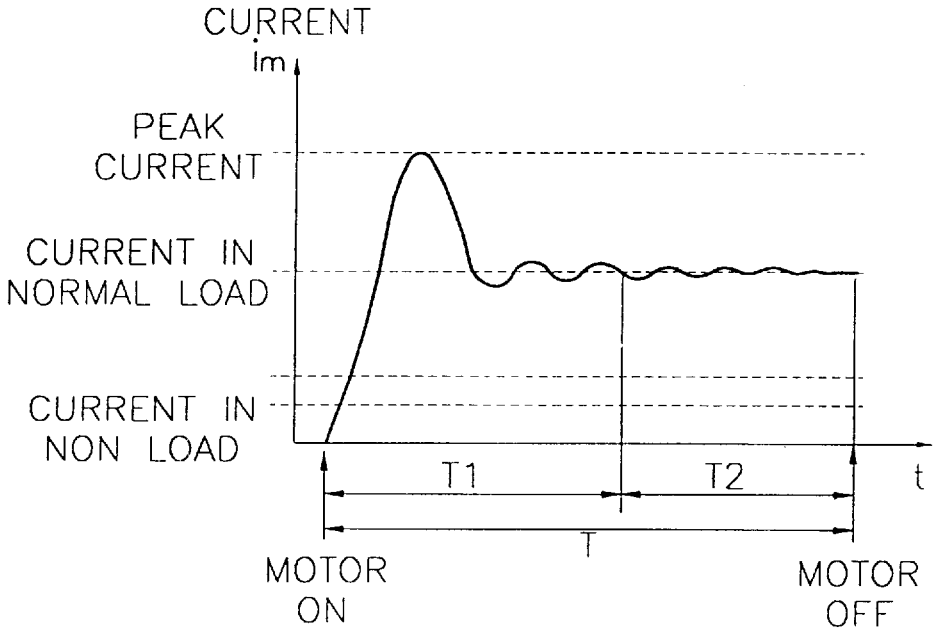
FIG. 7 is a graph showing the motor current of a water supply pump according to te present invention when a water supply reservoir is full.

In the initial process carried out in step S100, the non-load current corresponding to the empty water supply reservoir is established, and a table for the water supply time according to the normal current is established. The amount of the water supplied to the ice tray when the water supply reservoir is full is determined according to the operating time of the water supply pump, as shown in FIG. 6. The amount of water passing through the water pipe per unit time is in direct relation with motor current, hence the water supply time needs to be adjusted according to the non-load current.

In an embodiment according to the present invention, the table for establishing the water supply time according to the motor current in normal load is predetermined, the amount of the water supplied is adjusted by the water supply time corresponding to the detected motor current. Referring to FIG. 6, in the initial stage the motor operates at the peak current shown, then in the normal load current. At this time, the average value Iav of the motor current during T1 is acquired and corresponding T2 is determined from the table, so that the amount of the water supply can be adjusted more precisely.

The time T2 for stopping the water supply motor is acquired according to the table 1.

| T1 = 2 sec | | | | | | | |
|---|---|---|---|---|---|---|---|
| Iav(mA) | 120~ | 130~ | 140~ | 150~ | 160~ | 170~ | 180~ |
| T2(sec) | 8 | 7.5 | 7 | 6.5 | 6 | 5.5 | 5 |

As shown in the table 1, when the average value of the motor current is about 135 mA, T2 is determined to be 7.5 sec, and the total time of the water supply T is T=2+7.5=9.5 sec.

In the initial process, the predetermined non-load current value $i_{th}$ is set little higher than the non-load current.

After the initial process, the mi-com 50 turns on the relay RL1 of the water supply driving means 55 via digital output port DO1 to start the operation of the water supply step S101.

Once the water supply motor 13*a* is driven, the mi-com starts the timer for neasuring the water supply time, and detects the current $i_m$ flowing to the water supply motor 13*a* by the hall sensor 45. That is, when the water supply motor is driven, the current flows between the water supply motor driving part 55 and the water supply motor 13*a*. At this time, a magnetic field in proportion with the magnitude of the motor current is generated from the wire 41.

Accordingly, the magnetic field is detected according to the hall voltage $V_H$ by the hall sensor 45 installed on the cydrical yoke 42.

When the water in the water supply reservoir is depleted the motor current conducting on the wire 41 decreases to the non-load current. At this stage, the current decreases to 80 mA from normal load current of 90 to 150 mA.

Referring to step s104 in FIG. 5, as the detected motor current is less than or equal to the predetermined non-load current, the water supply motor 13*a* is turned off, indicated by the step s113, and the LED is turned on to indicate the depleted status of the water supply reservoir.

In the step s105, if the detected motor current is higher than the predetermined non-load current, a corresponding water supply time is determined from the table established in the initialization process.

If the time of the timer started in step s102 is equal to or greater than the determined water supply time from the table, the timer is reset in step s107, and the water supply motor is turned off in step s108. At this time, the water supply is stopped by turning off relay RL1.

After the water is supplied to the ice tray 15, an ice making process begins. Typically, the freezing process is accomplished by providing a cool air to the freezer compartment. The completion of freezing process is determined by a predetermined freezing time or by a thermometer attached to the ice tray 15.

Once the freezing is completed, the ice tray is rotated downward to dislodge the ice into the storage bin 17 in step s109. Namely, the mi-com 50 drives the ice tray turning motor 54 by activating the motor reverse driving part 53. Once all the ice has been discharged from the ice tray 15, the ice tray turning motor 54 is rotated in reverse to return the ice tray 15 to tis original position.

The sensing switch SW1 installed in the storage bin 17 checks the level of ice in the bin.

Figure 8:
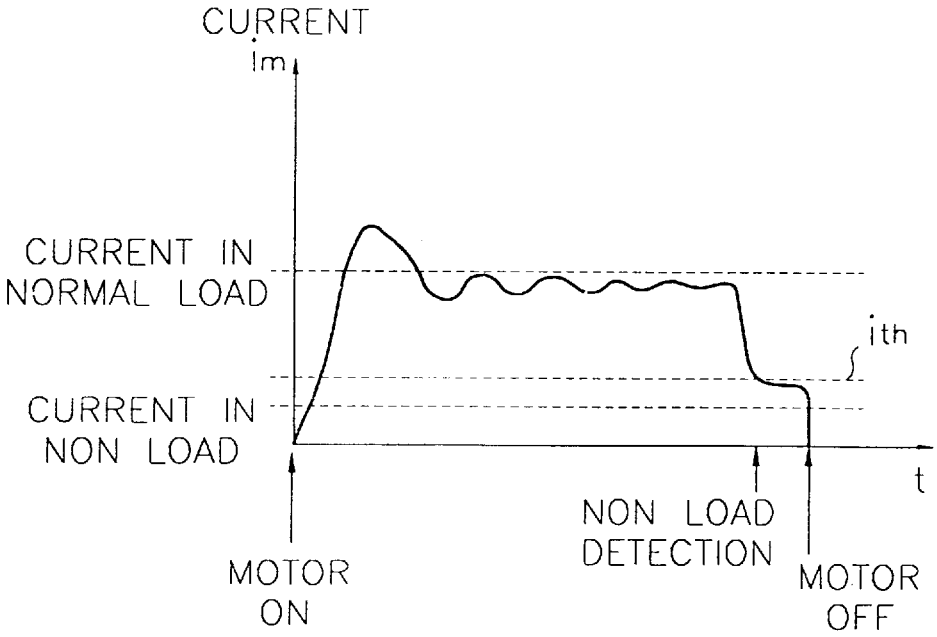
FIG. 8 is a graph showing an electrical current trend from the beginning to end of an operation of a water supply motor.

FIG. 8 shows an electrical current trend from the beginning to end of an operation of the water supply motor 13*a*.

When the water supply motor 13*a* is turned on, the motor current temporally rises above the normal load current, but it is quickly maintained in the normal load current range. As the reservoir becomes depleted, the motor current $i_m$ falls to the non-load current. The hall sensor 45 detects the non-load current. Consequently, the water supply motor 13*a* is turned off, and the LED displays the depleted status of the water reservoir 11.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A method for controlling water supply in an automatic ice maker for supplying the water stored in a water reservoir to an ice tray by operating a water supply pump, comprising the steps of:

establishing a table for a water supply time versus a non-load current;

starting a timer for measuring the water supply time after turning on a water supply motor;

detecting the current in said water supply motor by using a hall sensor;

turning off said water supply pump and displaying the depleted status of a water supply reservoir when the water supply motor current detected by said hall sensor is equal to or less than the non-load current;

determining a water supply time corresponding to the water supply motor current from said table when the detected water supply motor current is higher than the non-load current; and turning off said water supply motor after resetting said timer if current time of said timer is equal to or greater than the determined water supply time.

2. A water supply control device in an automatic ice maker for supplying the water stored in a water reservoir to an ice tray by operating a water supply pump, comprising:

a driving means for driving a water supply motor to operate a water supply pump according to a control signal;

a hall sensor for detecting magnetic field generated by the current in said water supply motor;

an amplifier for amplifying an output of said hall sensor;

a display circuit for displaying the depleted status of said water supply reservoir; and a mi-com for:

starting a timer after tuning on said water supply motor; outputting an amplified signal to an analog input port to detect a motor current; comparing the motor current to a non-load; outputting a control signal to turn off said water supply motor and to said display circuit when the non-load current is detected, whereas outputting a control signal to turn off the water supply motor after determining a water supply time corresponding to the detected current greater than the non-load current, if the current time of said timer is greater than or equal to the corresponding water supply time.

3. The water supply control device of claim 2, wherein a cylindrcal yoke surrounds a wire connecting said driving means and said motor, and said hall sensor is located in said cylindrical yoke.

4. The water supply control device of claim 2, wherein a wired core is located in the vicinity of a wire connecting said driving means and said motor, and the magnitude generated by said wired core is detected by said hall sensor.

* * * * *